US007732396B2

(12) United States Patent
Goda et al.

(10) Patent No.: US 7,732,396 B2
(45) Date of Patent: Jun. 8, 2010

(54) PROCESS FOR PRODUCING A GRANULAR ANIONIC SURFACTANT

(75) Inventors: Hisashi Goda, Wakayama (JP); Taiji Nakamae, Wakayama (JP); Kazuhito Miyoshi, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 11/017,830

(22) Filed: Dec. 22, 2004

(65) Prior Publication Data

US 2005/0170993 A1 Aug. 4, 2005

(30) Foreign Application Priority Data

Dec. 26, 2003 (JP) ..... 2003-432157

(51) Int. Cl.
*C11D 17/00* (2006.01)

(52) U.S. Cl. ..... 510/445; 510/446

(58) Field of Classification Search ..... 510/444, 510/445, 446, 457; 159/6.3, 47.1
See application file for complete search history.

(56) References Cited

U.S. PATENT DOCUMENTS

| | | | |
|---|---|---|---|
| 4,144,226 A | 3/1979 | Crutchfield et al. | |
| 4,146,495 A | 3/1979 | Crutchfield et al. | |
| 5,795,856 A | 8/1998 | Hatano et al. | |
| 2005/0043202 A1* | 2/2005 | Umehara et al. | 510/444 |

FOREIGN PATENT DOCUMENTS

| | | | |
|---|---|---|---|
| EP | 0572957 | A2 | 12/1993 |
| EP | 0816486 | A1 | 1/1998 |
| JP | 54-52196 | A | 4/1979 |
| JP | 54-106428 | A | 8/1979 |
| JP | 57-209633 | * | 12/1982 |
| JP | 62-191417 | A | 8/1987 |
| JP | 62-191419 | A | 8/1987 |
| JP | 5-331496 | A | 12/1993 |

* cited by examiner

*Primary Examiner*—Necholus Ogden, Jr.
(74) *Attorney, Agent, or Firm*—Birch, Stewart, Kolasch & Birch, LLP

(57) ABSTRACT

The invention provides a granular anionic surfactant and a detergent composition blended with the same. Disclosed are a process for producing a granular anionic surfactant, which including stirring particles containing 50 to 100 wt % of an anionic surfactant at a temperature at which the anionic surfactant exhibits thermoplasticity at a stirring Froude number as defined below by equation (i) of 0.1 or more and less than 2.0; a granular anionic surfactant obtained by the process; a granular anionic surfactant having a surface roughness (Ra) of 1.0 μm or less; and a detergent composition comprising the granular anionic surfactant.

$$Fr=V/[(R\times g)^{0.5}] \quad \text{(i)}$$

wherein Fr is Froude number, V is the peripheral speed at the top of a stirring blade [m/s], R is the radius of gyration of a stirring blade [m], and g is the acceleration of gravity [m/s$^2$].

6 Claims, No Drawings

PROCESS FOR PRODUCING A GRANULAR ANIONIC SURFACTANT

FIELD OF THE INVENTION

The present invention relates to a granular anionic surfactant which can be used preferably in a clothing detergent, a kitchen detergent, a toothpaste foaming agent, shampoo powder, a polymerization emulsifier, a cement foaming agent etc., a process for producing the same, and a detergent composition containing the same.

PRIOR ARTS

As a conventional process for producing a powdery or granular anionic surfactant, a process that involves spray-drying high-conc. slurry at a solids content of 60 to 80 wt % by utilizing the minimum viscosity (JP-A 54-106428) and a process that involves drying high-conc. slurry at a solids content of 60 to 80 wt % in a vacuum film dryer (JP-A 5-331496) are known.

SUMMARY OF INVENTION

The present invention provides a process for producing a granular anionic surfactant, which including stirring particles containing 50 to 100 wt % of an anionic surfactant at a temperature at which the anionic surfactant exhibits thermoplasticity at a stirring Froude number as defined below by equation (i) being 0.1 or more and less than 2.0:

$$Fr=V/[(R\times g)^{0.5}] \quad \text{(i)}$$

wherein Fr is Froude number, V is a peripheral speed at the top of a stirring blade [m/s], R is the radius of gyration of a stirring blade [m] and g is the acceleration of gravity [m/s$^2$].

The invention provides a granular anionic surfactant obtained by the above shown process.

The invention provides a granular anionic surfactant having a surface roughness (Ra) of 1.0 μm or less.

The invention provides a granular anionic surfactant having a surface roughness (Ra) of 1.0 μm or less and a generated dust amount of 400 CPM or less.

The invention provides a detergent composition containing any of the above shown granular anionic surfactants and use of any of the above shown granular anionic surfactants as a detergent.

DETAILED EXPLANATION OF THE INVENTION

In JP-A 54-106428 and JP-A 5-331496, however, fine powder of the anionic surfactant occurs on the surfaces of particles through adhesion etc., and may generate dust in handling and transportation. In this case, even if the fine powder is removed by a vibrating classification screen or an air classifier, the treatment time is prolonged because of a relatively large amount of fine powder, which may result in disintegration of the particles to generate fine powder. Particularly when the surfaces of the particles are not smooth, dust is generated upon rubbing the particles against one another in handling and transportation, and the outward appearance, such as transparency or lustrous appearance, of such particles does not satisfy the consumer's sense of beauty.

A purpose of the present invention is to provide a granular anionic surfactant of low dust generation and having an excellent appearance and a detergent composition blended with the same.

According to the present invention, there can be obtained a granular anionic surfactant having transparency and lustrous appearance, having a smooth surface, with suppressed dust generation. In addition, a granular anionic surfactant of low dust generation can be obtained by establishing the preferable temperature condition in a stirring granulator having a stirring blade, without compounding other agents and without surface treatment. Further, a detergent composition compounded with the granular anionic surfactant of low dust generation and having an excellent appearance can be obtained.

[Anionic Surfactant]

The anionic surfactant used in the present invention includes alkyl benzene sulfonates, alkyl or alkenyl ether sulfates, alkyl or alkenyl sulfates, α-olefin sulfonates, α-sulfofatty acid salts or esters, and alkyl or alkenyl ether carbonates etc. Among these, at least one kind of sulfate selected from the group consisting of linear or branched alkyl or alkenyl sulfates represented by formula (I) and polyoxyalkylene alkyl ether sulfates represented by formula (II) can be preferably used.

$$(R^1O\text{—}SO_3)_pM^1 \quad \text{(I)}$$

wherein $R^1$ is a C8 to C20 linear or branched alkyl or alkenyl group, $M^1$ is a cation, and p is the valence of $M^1$, which is 1 or 2.

$$(R^2O\text{-}(AO)_mSO_3)_qM^2 \quad \text{(II)}$$

wherein $R^2$ is a C8 to C20 linear or branched alkyl or alkenyl group, A is a C2 to C4 alkylene group, A's whose number is m may be the same or different, m is a number of 0 to 2 indicating the number of moles of alkylene oxide added on average, $M^2$ is a cation, and q is the valence of $M^2$, which is 1 or 2.

When the number of carbon atoms in $R^1$ and $R^2$ in formulae (I) and (II) is relatively small, caking properties upon powdering tend to be lowered, while when the number of carbon atoms therein is too large, performance such as powder solubility etc. tends to be lowered, and thus the number of carbon atoms is preferably 8 to 20, more preferably 10 to 18. AO is preferably an oxyalkylene group wherein the number of carbon atoms is 2 to 4, particularly 2. m is 0 to 2, preferably 0 to 1, more preferably 0 to 0.8, from the viewpoint of giving excellent powder characteristics and improving the caking properties of powder. Each of $M^1$ and $M^2$ is preferably an alkali metal atom such as Na and K, an alkaline earth metal atom such as Ca and Mg, or an alkanol-substituted or unsubstituted ammonium group, particularly preferably an alkali metal atom, especially Na.

These anionic surfactants are obtained generally in the form of an aqueous solution or paste by sulfating a higher alcohol or a higher alcohol/alkylene oxide (for example, ethylene oxide, propylene oxide etc.) adduct and then neutralizing the product. In the sulfating reaction, the unreacted product may be present in the range of 20 wt % or less, preferably 10 wt % or less, more preferably 5 wt % or less.

[Anionic Surfactant-Containing Particles]

The anionic surfactant-containing particles used as the starting material in the present invention contain the anionic surfactant in an amount of 50 to 100 wt %, preferably 70 to 100 wt %, more preferably 80 to 100 wt %, still more preferably 90 to 100 wt %, from the viewpoint of increasing the purity of the surfactant. In addition to the anionic surfactant, other components described later can be contained in an amount of 0 to 50 wt % in the particles. The amount of the other components compounded can be changed suitably depending on applications of the granular anionic surfactant of the present invention, but from the viewpoint of maintaining the original characteristics of the surfactant, the amount is preferably 0 to 30 wt %, more preferably 0 to 20 wt %, still more preferably 0 to 10 wt %.

Physical properties of the anionic surfactant-containing particles used as the starting material in the present invention are preferably as follows:

(1) The lower limit of the average particle diameter, from the viewpoint of dust generation, and the upper limit from the viewpoint of solubility etc., are in the range of preferably 100 to 4000 μm, more preferably 500 to 2000 μm, still more preferably 1000 to 1500 μm.

(2) The bulk density is in the range of preferably 300 to 1000 $kg/m^3$, more preferably 600 to 800 $kg/m^3$.

(3) The water content of the granular product is preferably 0.3 to 2.5 wt %, more preferably 0.3 to 2.0 wt % from the viewpoint of caking properties, still more preferably 1.0 to 2.0 wt % from the viewpoint of reducing the amount of dust generated.

The anionic surfactant-containing particles may be obtained in any methods. The anionic surfactant-containing particles can be obtained for example by powdering the anionic surfactant by a method described in JP-A 54-106428, JP-A 5-331496 or the like and then subjecting it to compress granulation such as agitation and tambling granulation, extrusion granulation or tabletting/briqueting. It is preferable for this step that the particles containing the anionic surfactant is nearly spherical, even more preferably being a real sphere.

It is preferable in the method of the invention that an anionic surfactant paste is added to a powdery material at a reduced pressure in a granulator having a stirring blade and a crushing blade, while the material is dried and simultaneously granulated, to produce anionic surfactant-containing particles, can be used even more preferably because the anionic surfactant-containing particles can be produced directly from the anionic surfactant paste, and subsequently the stirring treatment according to the present invention can be conducted in the same apparatus to produce the granular anionic surfactant of low dust generation. In this method, the temperature of powder and particles in the granulator having a stirring blade and a crushing blade described later is in the range of preferably 40 to 75° C., more preferably 45 to 70° C. Preferably, the temperature is substantially constant. The term "substantially constant temperature" means, for example, that the change in temperature during drying and simultaneous granulation is preferably regulated so as to be within ±5° C., preferably ±2° C., more preferably ±1° C. The method of regulating the temperature change in this range includes methods which involve suitably regulating (1) speed of addition of the anionic surfactant paste, (2) pressure in the granulator, (3) temperature of a jacket in the granulator, (4) introduction of air and an inert gas into the granulator, and (5) Froude number of a blade of the granulator. Hereinafter, each method is described in detail.

(1) Speed of Addition of the Anionic Surfactant Paste

The speed of addition of the anionic surfactant paste is regulated such that the temperature of the granular product is in the range described above. The amount of the anionic surfactant paste added is determined preferably such that the ratio of the anionic surfactant paste to the powdery material by weight is from 1/10 to 10/1, particularly from 1/4 to 4/1.

(2) Pressure in the Granulator

The pressure in the granulator is preferably 0.67 kPa to 40 kPa from the viewpoint of suppressing decomposition of the paste and granular product by decreasing the operational temperature, more preferably 4.0 kPa to 40 kPa, even more preferably 4.0 to 8.0 kPa, from the viewpoint of burden on a vacuum pump and air-tightness of the granulator.

(3) Temperature of a Jacket in the Granulator

A heating source in the granulator includes a hot-water jacket, electric tracing etc., and the hot-water jacket is preferable. The jacket temperature is preferably 20° C. to 100° C., more preferably 45° C. or higher from the viewpoint of shortening the drying time and improving the productivity, more preferably 90° C. or lower from the viewpoint of application to a starting material sensitive to heat.

(4) Introduction of Air and/or an Inert Gas into the Granulator

For more efficient drying, air and/or an inert gas such as nitrogen may be introduced into the granulator during addition of the anionic surfactant paste. The granular product can be cooled with the gas to prevent the granular product from forming large lumps. The amount of the gas introduced is preferably 2 to 30 L/min., more preferably 3 to 10 L/min.

(5) Froude Number of a Blade of the Granulator

From the viewpoint of promoting consolidation and sufficiently increasing the amount of the adhering material to narrow particle-size distribution, the Froude number defined by the equation (i) above is preferably 1 to 5, more preferably 1.5 to 4.

In the granulator equipped with a crushing blade, the Froude number of the crushing blade at the time of drying and simultaneous granulation is 5 to 40, preferably 10 to 30.

[Process for Producing the Granular Anionic Surfactant]

In the present invention, the particles containing 50 to 100 wt % anionic surfactant, obtained by the method described above, are subjected to stirring treatment at the temperature at which the anionic surfactant shows thermoplasticity to give the granular anionic surfactant.

In the stirring treatment, the anionic surfactant-containing particles are fed to a stirring granulator. The shape of the particles to be fed is not particularly limited, but for the purpose of smoothing the surfaces of the particles by tambling, the shape is preferably spherical and more preferably near to roundness.

The particle temperature at which the anionic surfactant shows thermoplasticity and the number of revolutions of a stirring blade are involved in preferable conditions for producing the granular anionic surfactant of the present invention by a stirring granulator.

The temperature of the anionic surfactant-containing particles to be fed is not particularly limited, but is preferably the temperature at which the surfactant is substantially not decomposed. The stirring treatment is carried out at the temperature at which the surfactant shows thermoplasticity so that for preventing dust from increasing upon heating of the particles in the granulator, the particles are previously heated and then fed to the granulator.

The temperatures of the particles treated in the granulator is varied depending on the type of the anionic surfactant, but is generally preferably 30 to 90° C., more preferably 35 to 85° C., even more preferably 40 to 85° C. from the view point of exhibiting thermoplasticity, but not causing thermal decomposition. The temperature at which thermoplasticity is exhibited can be roughly estimated from a phase change temperature determined with Differential Scanning Calorimeter (DSC).

Even if the temperature of the particles is regulated so as to be the optimum temperature, fine powder may be generated at a higher rate of the stirring blade to broaden particle size distribution and increase the amount of dust generated. Accordingly, the number of revolutions of the stirring blade, in terms of Froude number defined by the equation (i) above, is 0.1 or more and less than 2.0, preferably 0.1 to 1.5, more preferably 0.1 to 1.0, even more preferably 0.1 to 0.7.

In the granulator equipped with a crushing blade, the particles are crushed to generate fine powder to increase the amount of dust generated, and it is thus preferable that the crushing blade is substantially not rotated. The phrase "the crushing blade is substantially not rotated" means that the crushing blade is substantially not rotated, and that in consideration of the shape, size etc. of the crushing blade, the crushing blade is rotated for the purpose of preventing the particles from retaining in the vicinity of the crushing blade, within such a range that the anionic surfactant is not crushed. Specifically, when the crushing blade is continuously rotated, the Froude number is 5 or less, preferably 3 or less, more preferably 0, and when the crushing blade is intermittently rotated, the Froude number is not particularly limited. By preparation under such conditions, the granular anionic surfactant of low dust generation can be obtained.

In the stirring granulator used in the present invention, it is extremely preferable that clearance is formed between the stirring blade upon rotating and the wall surface. The average clearance is preferably 1 to 50 mm. The stirring granulator having such structure includes, for example, Henschel mixer (manufactured by Mitsui Mining Co., Ltd.), a high-speed mixer (manufactured by Fukae Powtec Co., Ltd.), a vertical granulator (manufactured by Powrex), Redige mixer (manufactured by Matsubo Co., Ltd.), Proshear mixer (Pacific Machinery & Engineering Co., Ltd.) etc. When the continuous Redige mixer or Proshear mixer is used, the particles can be continuously prepared.

The stirring treatment time is preferably 1 minute or more, more preferably 5 minutes or more, under the conditions of the preferable particle temperature and number of revolutions of the stirring blade, in order to effectively reduce the mount of dust generated. The upper limit is not particularly limited, but is preferably 2 hours or less, more preferably 1 hour or less.

The pressure in the granulator during treatment may be either atmospheric pressure or reduced pressure, and the conditions may be suitably selected depending on purposes such as control of water content in the particles and easiness of operation.

For the purpose of reducing the amount of dust generated, the stirring treatment may be conducted in the stirring granulator, followed by removing fine powder by a vibrating classification screen or an air classifier, to sift the particles according to desired product specifications. The air classifier used in the present invention may be Q Unit Vibrational Cooling Machine, G-456 model manufactured by Tamagawa Kikai Co., Ltd., and Agglo-Master, AGM-2M-PJ/SD manufacture by Hosokawa Micron Co., Ltd., etc. The gas flow speed required for classification depends on the size of classified particles, but may be usually 0.2 to 1.5 m/s. Further, the vibrating classification screen used in the present invention may be a vibrating screen, 502 model manufactured by Dalton and Gyro Sifter, GS-132-25 AM manufactured by Tokuju Kousakujo Co., Ltd, etc.

[Granular Anionic Surfactant]

The granular anionic surfactant of the present invention obtained by the method described above is in the form of particles of low dust generation, has a smooth particle surface and is excellent in appearance such as transparency or lustrous appearance.

With the "low dust generation" in the present invention given, it is meant that the amount of dust generated is 500 CPM or less. For securing safety in working atmosphere, the amount of dust generated is preferably lower, more preferably 400 CPM or less, even more preferably 300 CPM or less, even more preferably 150 CPM or less.

When the average particle diameter of the granular anionic surfactant is too small, the granules themselves can become dust, and thus the average particle diameter is preferably 100 μm or more, more preferably 500 μm or more, even more preferably 1000 μm or more. From the viewpoint of preventing the particles from being unclassifiable upon compounding into a clothing detergent or from being insoluble upon use, the average particle diameter is preferably 4000 μm or less, more preferably 2000 μm or less, even more preferably 1500 μm or less. From the viewpoint of low dust generation and prevention of the particles from being unclassifiable or insoluble, therefore, the average particle diameter of the granular anionic surfactant is preferably 100 to 4000 μm, more preferably 500 to 2000 μm, even more preferably 1000 to 1500 μm.

The granular anionic surfactant obtained by the method of the present invention is characterized in that the surfactant has a very transparency and lustrous appearance, and simultaneously the surfaces of the particles are smooth, that is, a surface roughness (Ra) of the particles is small. The surface roughness of the granular anionic surfactant is preferably 1 μm or less, more preferably 0.1 to 1 μm, even more preferably 0.1 to 0.8 μm, from the viewpoint of suppressing the increase of the amount of dust generated and preventing caking.

It is preferable that the granular anionic surfactant obtained by the process according to the invention has a surface roughness (Ra) of 1.0 μm or less and/or a generated dust amount of 400 CPM or less.

From the viewpoint of handleability upon production and application, the caking properties of the granular anionic surfactant are preferably lower, and can be evaluated in terms of the degree of passage through screen. The degree of passage through screen is preferably 80% or more, more preferably 90% or more.

From the viewpoint of handling, the fluidity of the granular anionic surfactant is preferably short in time. The fluidity time is 10 sec. or less, more preferably 7 sec. or less.

In the present invention, a granular anionic surfactant having a surface roughness (Ra) of 1 μm or less and a smooth surface, suppressed from dust generation, and having transparency and lustrous appearance can be obtained by stirring particles containing 50 to 100 wt % of an anionic surfactant, obtained in any production process, at a temperature at which the anionic surfactant exhibits thermoplasticity at a stirring Froude number as defined below by equation (i) being 0.1 or more and less than 2.0.

Moreover a granular anionic surfactant having a surface roughness (Ra) of 1 μm or less and a dust generation of 400 CPM or less, more suppressed from dust generation, can be obtained by drying and simultaneously granulating a powdery material, while adding an anionic surfactant paste to the powdery material at a reduced pressure in a granulator having a stirring blade and a crushing blade and a substantially constant temperature to obtain anionic surfactant-containing particles and then stirring the obtained anionic surfactant-containing particles in the above conditions.

In addition, a granular anionic surfactant having a surface roughness (Ra) of 1 μm or less and a dust generation of 150

CPM or less, even more suppressed from dust generation, can be obtained by stirring the above obtained anionic surfactant-containing particles in the above conditions according to the invention and then removing fine particles by a vibrating classification screen and/or an air classifier.

In the present invention, physical properties of the granular anionic surfactant are measured by the following methods.

<Dust Generation>

A digital dust meter is arranged in a measurement container made of an opaque wall, 280 mm in width, 480 mm in length and 472 mm in height, so that an absorbing measurement opening may be directed to the center of the measurement container and the opposite side to the measurement opening may be placed at a distance of 10 mm from the surface of the 280 mm width. Then a container prescribed in JIS K 3362 is arranged, to meet the center of the surface of the 280 mm width which is far of the measurement opening, perpendicularly so that the bottom surface thereof may be at a height of 370 mm from the bottom of the measurement container. 50 g granular anionic surfactant is placed in the container, and a shutter in the bottom of the JIS K 3362 container is opened to drop the granular anionic surfactant into the measurement container. Immediately after dropping, the measurement container is sealed by capping the top thereof. The amount of dust generated for 1 minute, that is, 30 seconds to 90 seconds after dropping of the granular product, is measured and expressed as the amount of dust generated.

The dust meter used in this measurement is not particularly limited, and for example dust meter model P-5H (manufactured by Shibata Kagaku Kiki Kogyo Co., Ltd.) can be used.

<Caking Properties>

70 g granular anionic surfactant is sealed in a vinyl chloride bag provided with a fastener of 0.04×70×100 mm, and a loading of 1000 kg/m$^2$ is uniformly applied downwards thereon, and after 7 days at a storage temperature of 50° C., the caking state is judged. The sample after the test is quietly poured onto a screen having 2000 μm openings prescribed in JIS Z 8801 and tapped 10 times with a Ro-Tap type screen shaker, and the degree of passage is determined according to the following equation:

$$\text{Degree of passage (\%)}=[\text{weight of powder having passed } (g)/\text{weight of the whole sample } (g)]\times 100$$

<Fluidity Time>

The fluidity time is defined as the time required for 100 mL powder to flow out through a hopper for bulk density measurement prescribed in JIS K 3362.

<Surface Smoothness>

In the present invention, the granular anionic surfactant excellent in surface smoothness refers to the one having a surface roughness of 1.0 μm or less, more preferably 0.8 μm or less. A surfactant of lower surface roughness works effectively to improve dust generation, caking properties and fluidity.

The surface roughness described in the present invention is an arithmetic average roughness (Ra) prescribed in JIS B 0601-1994, which refers to an average value determined by filtering an image taken with a measurement resolution of 0.02 μm with a 50-power lens (type, simple average; size, 5×5 pixels; number of times, 2), and then measuring 6 sites (cutoff value, 0.08 mm; evaluation length, 0.48 mm) selected at random from an upper part of a particle.

The surface smoothness measuring device used in measurement is not particularly limited insofar as the minimum measurement resolution of 0.01 μm is satisfied, and for example, a super deepness shape measuring microscope VK-8500 (manufactured by KEYENCE) can be used.

The analysis method is not particularly limited, and for example VK shape analysis software (manufactured by KEYENCE) can be used.

<Average Particle Diameter>

The average particle diameter is determined from weight distribution by the size of screen opening after vibration of a sample on a standard screen in JIS Z 8801 (opening: 2000 to 45 μm) for 5 minutes.

<Bulk Density>

The bulk density is measured according to a method prescribed in JIS K 3362.

[Other Components]

The granular anionic surfactant of the present invention can be compounded with a surfactant other than the anionic surfactant. As the surfactant other than the anionic surfactant, use can be made of a nonionic surfactant and if necessary a cationic surfactant and an amphoteric surfactant. The nonionic surfactant includes polyoxyalkylene alkyl ether, polyoxyalkylene alkyl phenyl ether, polyoxyalkylene fatty ester, polyoxyethylene polyoxypropylene alkyl ether, polyoxyalkylene alkyl amine, glycerin fatty ester, higher fatty alkanol amide, alkyl glycoside, alkyl glucose amide and alkyl amine oxide. A C10 to C18, preferably C12 to C14, alcohol/ethylene oxide adduct, or a mixture of ethylene oxide/propylene oxide adducts which are polyoxyalkylene alkyl ethers wherein the number of moles of alkylene oxide added on average is 5 to 30, preferably 6 to 15, is preferable in respect of detergency. Polyoxyethylene polyoxypropylene alkyl ether is preferable in respect of detergency and solubility. This compound can be obtained by reacting propylene oxide, further ethylene oxide, with a C10 to C18, preferably C12 to C14, alcohol/ethylene oxide adduct. The cationic surfactant includes alkyl trimethyl ammonium salt etc., and the amphoteric surfactant includes carbobetaine- or sulfobetaine-based surfactants.

Further, the granular anionic surfactant of the present invention can be blended with water-soluble inorganic salts such as carbonates, bicarbonates, silicates, sulfates, sulfites or phosphate, from the viewpoint of increasing ionic strength in a washing solution.

The granular anionic surfactant of the present invention can further be blended with alkali metal silicates. The alkali metal silicates used may be crystalline or amorphous, but crystalline silicates are preferably contained because they also have an ability to exchange cations. From the viewpoint of alkali performance, the ratio of $SiO_2/M_2O$ (M is an alkali metal) in the alkali metal silicate is preferably 2.6 or less, more preferably 2.4 or less, still more preferably 2.2 or less. From the viewpoint of storage stability, the ratio is preferably 0.5 or more, more preferably 1.0 or more, still more preferably 1.5 or more, further more preferably 1.7 or more. The amorphous alkali metal silicates include, for example, sodium silicate JIS Nos. 1 and 2, granules of dried products of water-glass, that is, Britesil C20, Britesil H20, Britesil C24, Britesil H24 (all of which are registered trademarks, manufactured by The PQ Corporation), etc. A sodium carbonate/amorphous alkali metal silicate complex NABION 15 (registered trademark, manufactured by RHONE-BOULENC) may also be used.

The alkali metal silicate, upon crystallization, has excellent alkali performance and cation exchangeability comparative to that of 4A type zeolite, and is a very preferable base material from the viewpoint of low-temperature dispersibility. The granular anionic surfactant of the present invention can contain at least one kind of crystalline alkali metal silicate selected from compounds represented by formula (IV) or (V):

$$x(M^3{}_2O).y(SiO_2).z(M^4{}_uO_v).w(H_2O) \quad (IV)$$

wherein $M^3$ represents the Ia group element in the periodic table (preferably K and/or Na), $M^4$ represents at least one member (preferably Mg, Ca) selected from the IIa group element, IIb group element, IIIa group element, IVa group element and VIII group element in the periodic table, and y/x is 0.5 to 2.6, z/x is 0.001 to 1.0, w is 0 to 20, and v/u is 0.5 to 2.0.

$$M^3{}_2O.x'(SiO_2).y'(H_2O) \quad (V)$$

wherein $M^3$ has the same meaning as defined above, x' is 1.5 to 2.6, and y' is 0 to 20, preferably substantially 0.

The crystalline alkali metal silicate is available under the trade name of Prefeed ($\delta$-$Na_2O.2SiO_2$) from Tokuyama Siltech Corporation. In particular, use thereof in combination with sodium carbonate is preferable.

From the viewpoint of improving the sequestering ability, the granular anionic surfactant of the present invention can compounded with organic acid salts such as citrate, hydroxyiminodisuccinate, methyl glycine diacetate, glutamic acid diacetate, asparagine diacetate, serine diacetate, ethylene diamine disuccinate, ethylene diamine tetraacetate etc. From the viewpoint of improving the sequestering ability, the dispersibility of solid particle dirt, etc., a cation-exchange polymer having a carboxylic acid group and/or a sulfonic acid group is preferably incorporated, and particularly acrylic acid/maleic acid copolymer salts having a molecular weight of 1,000 to 80,000, polyacrylates, and polyacetal carboxylates such as polyglyoxylate having a molecular weight of 800 to 1,000,000, preferably 5,000 to 200,000, described in JP-A 54-52196 are desirable.

The granular anionic surfactant of the present invention can be blended with crystalline aluminosilicates such as A-type, X-type and P-type zeolite. The average primary particle diameter of the crystalline aluminosilicate is preferably 0.1 to 10 μm. Amorphous aluminosilicate having an oil absorptivity of 80 mL/100 g or more according to the JIS K 5101 method can also be incorporated. As the amorphous aluminosilicates, those described in for example JP-A 62-191417, JP-A 62-191419 etc. can be mentioned.

The granular anionic surfactant of the present invention can also be compounded with a dispersant such as carboxymethyl cellulose, polyethylene glycol, polyvinyl pyrrolidone and polyvinyl alcohol, a color migration inhibitor, a bleaching agent such as percarbonate, a bleaching activator, an enzyme, a biphenyl- or stilbene-based fluorescent dye, a defoaming agent, an antioxidant, a bluing agent, a perfume etc.

The bleaching activator used in the present invention includes tetracetyl ethylene diamine, glucose pantacetate, tetracetyl glycoluril, compounds represented by formula (I) (II), (III) or (IV) (for example, sodium p-phenol sulfonate (sodium acetoxybenzene sulfonate, sodium benzoyloxybenzene sulfonate, linear or branched octanoyl/nonanoyl/decanoyl/dodecanoyl phenol sulfonate etc.) and p-hydroxy benzoates (acetoxybenzene carboxylic acid, octanoyloxy benzene carboxylic acid, decanoyloxy benzene carboxylic acid, dodecanoyloxybenzene carboxylic acid etc.)), etc., for instance, described in JP-A-8-3593.

The enzyme used in the present invention is not particularly limited, and examples include hydrolases, oxidoreductases, lyases, transferases and isomerases, and particularly preferable examples include cellulase, protease, lipase, amylase, pullulanase, esterase, hemicellulase, peroxidase, phenol oxidase, protopectinase and pectinase. Two or more of these enzymes may be used. In consideration of the dispersibility of a colorant upon granulation of the enzyme and stainability on clothes, a combination of protease and cellulase is particularly preferable. The reason for this is not evident, but it is estimated that the effect of cellulase on removal of cortex in the inside of fibers can be improved by combination with the effect of protease on removal of stains and keratin on the surfaces of fibers, thus preventing a dye from remaining in cortex components etc.

The enzyme is not particularly limited, and may be produced in any methods, and usually an enzyme obtained by filtering a culture containing the enzyme produced by a microorganism and then drying the filtrate is used. A stabilizer, sugars, inorganic salts such as sodium sulfate etc., polyethylene glycol, impurities, water etc. may also be contained depending on culture conditions, separation condition etc.

In the method of compounding these and other components, the components may be added separately in the step of granulation in producing the anionic surfactant-containing particles, or may be added previously to an aqueous solution or paste of the anionic surfactant. From the viewpoint of the stability of the anionic surfactant, addition of alkalis such as silicates, carbonates, sesquicarbonates (Na, K, Mg salts etc.) etc. is one of preferable embodiments. If necessary, the other components may be separately added after the granular anionic surfactant is obtained by the process of the present invention. For example, surface modification of the granular anionic surfactant may be conducted by adding fine aluminosilicate particles according to a known method. Addition thereof to the detergent composition is also one of effective embodiments.

The granular anionic surfactant may be prepared and used as a preparation which was dry-mixed with cement, components contained in cement, such as calcium oxide, calcium hydroxide, calcium sulfate etc., or with powder not exerting adverse influence after application.

[Detergent Composition]

The granular anionic surfactant of the present invention is added to, and mixed with, other detergent materials to constitute a detergent composition which is then formed if necessary into a preparation, to give a detergent excellent in resistance to hard water, foaming well even in hard water and excellent in low-temperature solubility, and thus the granular anionic surfactant is very useful as a detergent base material.

As the surfactant among the detergent materials in the present invention, not only the granular anionic surfactant of the present invention but also a nonionic surfactant and if necessary a cationic surfactant and an amphoteric surfactant can be used.

From the viewpoint of detergency, the content of the granular anionic surfactant in the detergent composition of the present invention is preferably 1 to 50 wt %, more preferably 5 to 30 wt %. The counterion of the anionic surfactant is preferably an alkali metal ion in respect of improvement of detergency.

The nonionic surfactant which can be incorporated into the detergent composition of the present invention can be exemplified by materials mentioned above in the item "Other components", among which polyoxyethylene polyoxypropylene alkyl ether is preferable in respect of detergency and solubility. The content of the nonionic surfactant in the detergent composition of the present invention is preferably 1 to 50 wt %, more preferably 5 to 30 wt %, from the viewpoint of detergency.

The cationic surfactant and amphoteric surfactant which can be incorporated into the detergent composition of the present invention can be exemplified by those mentioned above in the item "Other components".

From the viewpoint of detergency, achievement of desired powdery physical properties of the detergent composition, etc., the total content of the surfactants in the detergent composition of the present invention is preferably 10 to 60 wt %, more preferably 20 to 50 wt %, still more preferably 27 to 45 wt %.

From the viewpoint of improving ionic strength in a washing solution, the detergent composition of the present invention can be blended with water-soluble inorganic salts such as carbonates, bicarbonates, silicates, sulfates, sulfites, or phosphates. The amount (converted as the amount of anhydrides) of the carbonates incorporated into the detergent composition is preferably 25 wt % or less, more preferably 5 to 20 wt %, still more preferably 7 to 15 wt %, from the viewpoint of detergency and low-temperature dispersibility of the composition left in cold water for a long time. The sum (converted as the amount of anhydrides) of the carbonates and sulfates in the detergent composition is preferably 5 to 35 wt %, more preferably 10 to 30 wt %, still more preferably 12 to 25 wt %.

The detergent composition of the present invention can also be blended with alkali metal silicates illustrated above in the item "Other components". Crystalline alkali metal silicates are incorporated in an amount of preferably 0.5 to 40 wt %, more preferably 1 to 25 wt %, even more preferably 3 to 20 wt %, even more preferably 5 to 15 wt %, into the detergent composition of the present invention. The amount of the crystalline silicates is preferably 20 wt % or more, more preferably 30 wt % or more, still more preferably 40 wt % or more, based on the total amount of the alkali metal silicates.

From the viewpoint of improving the sequestering ability, the dispersibility of solid particle dirt, etc., the detergent composition of the present invention is blended preferably with organic acid salts illustrated above in the item "Other components" and cation-exchange polymers having a carboxylic acid group and/or a sulfonic acid group. The cation-exchange polymer and/or the organic acid salt is incorporated in an amount of preferably 0.5 to 12 wt %, more preferably 1 to 10 wt %, still more preferably 1 to 7 wt %, further more preferably 2 to 5 wt %, into the detergent composition.

The process for producing the detergent composition of the present invention and the shape of the detergent composition are not particularly limited, and the granular anionic surfactant of the present invention and the other detergent materials may be merely dry-blended by a V-type blender or a Nautor mixer (manufacture by Hosokawa Micron Co., Ltd.) or may be granulated.

When the composition is to be granulated, a binder may be incorporated if necessary. As the binder, aqueous solutions or pastes of the various surfactants described above can be used. In addition, cation-exchange polymers having a carboxylic acid group and/or a sulfonic acid group having a sequestering ability and an ability to decompose solid particle dirt, or polymer compounds such as polyethylene glycol, can also be used as effective binders. The granulation method is not particularly limited, and (1) agitation and tambling granulation method, (2) fluidized bed granulation method, (3) extrusion granulation method, and (4) compress granulation method by tabletting, briqueting, compounding etc. can be used to produce desired granulates of the detergent composition.

EXAMPLES

In the Examples, % refers to % by weight unless otherwise specified.

Synthesis Example 1

Together with 2.0 vol % sulfur trioxide gas, higher alcohol (molecular weight 199) wherein the number of carbon atoms in the alkyl group was 12 to 16 with a distribution of $C_{12}/C_{14}/C_{16}$=67%/28%/5%, was dropped continuously at 60° C. into, and reacted in, a film dropping reactor having an internal diameter of 14 mmϕ and a length of 4 m. The flow rate was regulated such that the reaction molar ratio of the sulfur trioxide gas to the higher alcohol became 1.01. The resulting sulfated product was neutralized with 32.2% aqueous sodium hydroxide, and 75% phosphoric acid (buffer agent) was added thereto, and the pH was made 10 by fine adjustment with 32.1% aqueous sodium hydroxide. The effective component of the resulting sodium alkyl sulfate paste (referred to hereinafter as paste 1) was 73%.

Synthesis Example 2

The same reaction as in Synthesis Example 1 was conducted except that a starting material (average molecular weight 209), wherein higher alcohol wherein the number of carbon atoms in the alkyl group was 12 to 16 with a distribution of $C_{12}/C_{14}/C_{16}$=67%/28%/5%, and an ethoxylate produced by adding ethylene oxide in an amount of 1.0 mol on average to the above higher alcohol by a potassium hydroxide catalyst, had been compounded in the ratio of 75%:25%, was used in place of the higher alcohol, and 30.1% aqueous sodium hydroxide was used. The effective component of the resulting sodium polyoxyalkylene alkyl sulfate paste (referred to hereinafter as paste 2) was 72%.

Preparation Example

While drying conditions were regulated such that the jacket temperature was 85° C., the pressure was 4.0 kPa, and the operational product temperature was 70±1° C., a paste prepared by mixing paste 1 with paste 2 in a weight ratio of 75:25 was dropped at an average rate of 150 kg/hr. into a vacuum drying machine with a volume of 2500 L (FDM-1200JE model manufactured by Fukae Powtec Co., Ltd.), and dried and simultaneously granulated under the granulation conditions where the number of revolutions of an agitator was 55 r/min (stirring Froude number, 1.8), the number of revolutions of a chopper was 2000 r/min (crushing Froude number, 25.9), and the average clearance between a stirring blade and a wall surface was 5.5 mm, whereby 600 kg granular product was obtained. A part of this granular product was pulverized by an atomizer (Fuji Powdal Co.) to give a powder material having an average particle diameter of 120 μm.

Example 1

130 kg sodium alkyl sulfate powder (EMAL 10P HD of Kao Corporation), average particle diameter 100 μm) was introduced into a vacuum drying machine with a volume of 2500 L (FDM-1200JE model manufactured by Fukae-Powtec Co., Ltd.), and while the drying conditions were regulated such that the jacket temperature was 85° C., the pressure was 5.3 kPa, and the product temperature was 55±3, paste 1 was dropped into the drying machine, and dried and simultaneously granulated under the granulation conditions where the stirring Froude number was 2.3 and the crushing Froude number was 25.9, whereby 654 kg granular product of sodium alkyl sulfate (average molecular weight, 301) with a generated dust amount of 740 (0.5 to 2.0 mm) CPM, an average particle diameter of 944 μm, a bulk density of 714 kg/m$^3$, a fluidity of 6.3 sec, a water content of 1.4% and the phase change temperature of 40° C. was obtained.

The resulting granular product was treated for 10 minutes under the following conditions: the number of revolutions of a stirring blade, 1.5 m/s (stirring Froude number, 0.5); chopper rotation, 0 r/min. (crushing Froude number, 0); jacket temperature, 85° C.; pressure, 5.3 kPa; and particle temperature, 54.3 to 59.5° C. The resulting granular anionic surfactant indicated a generated dust amount of 273 (0.5 to 2.0 mm) CPM, an average particle diameter of 964 μm, a bulk density of 718 kg/m$^3$, a fluidity of 5.9 sec and a water content of 1.4%. This product was further treated at a fluidizing air rate of 0.5 m/s in a horizontal continuous vibrational fluidized bed (Q Unit Vibrational Cooling Machine, Q-456 model, manufactured by Tamagawa Kikai Co., Ltd.), and then classified into particles of 500 to 2000 μm with a vibrating screen (702-C model manufactured by Dalton), where the amount of dust generated from the classified particles was 56 CPM and the surface roughness (Ra) was 0.49 μm.

Example 2

130 kg sodium alkyl sulfate powder (EMAL 10P HD of Kao Corporation), average particle diameter 100 μm) was introduced into a vacuum drying machine with a volume of 2500 L (FDM-1200JE model manufactured by Fukae-Powtec Co., Ltd.), and while the drying conditions were regulated such that the jacket temperature was 85° C., the pressure was 5.3 kPa, and the product temperature was 55±3° C., paste 1 was dropped into the drying machine, and dried and simultaneously granulated under the granulation conditions where the stirring Froude number was 2.3 and the crushing Froude number was 25.9, whereby 654 kg granular product of sodium alkyl sulfate (average molecular weight, 301) with a generated dust amount of 924 (0.5 to 2.0 mm) CPM, an average particle diameter of 1282 μm, a bulk density of 712 kg/m$^3$, a fluidity of 7.7 sec, a water content of 1.2% and the phase change temperature of 40° C. was obtained.

The resulting granular product was treated for 30 minutes under the following conditions: the number of revolutions of a stirring blade, 1.5 m/s (stirring Froude number, 0.5); chopper rotation, 0 r/min. (crushing Froude number, 0); jacket temperature, 85° C.; pressure, 5.3 kPa; and particle temperature, 57.5 to 62.7° C. The resulting granular anionic surfactant indicated a generated dust amount of 292 (0.5 to 2.0 mm) CPM, an average particle diameter of 1427 μm, a bulk density of 718 kg/m$^3$, a fluidity of 7.6 sec and a water content of 1.1%. This product was further treated at a fluidization air rate of 0.5 m/s in a horizontal continuous vibrational fluidized bed (Q Unit Vibrational Cooling Machine, Q-456 model, manufactured by Tamagawa Kikai Co., Ltd.), and then classified into particles of 500 to 2000 μm with a vibrating screen (702-C model manufactured by Dalton), where the amount of dust generated from the classified particles was 90 CPM. The surface roughness (Ra) was 0.25 μm.

Example 3

200 kg of the starting powder (average particle diameter, 120 μm) obtained in the Preparation Example was introduced into a vacuum drying machine with a volume of 2500 L (FDM-1200JE model manufactured by Fukae-Powtec Co., Ltd.), and while the drying conditions were regulated such that the jacket temperature was 85° C., the pressure was 4.0 kPa, and the product temperature was 70±0° C., paste 2 was dropped into the drying machine, and dried and simultaneously granulated under the granulation conditions where the stirring Froude number was 1.8 and the crushing Froude number was 25.9, whereby 331 kg granular product of sodium polyoxyethylene (added ethylene oxide in an amount of 0.25 mol on average) alkyl sulfate (average molecular weight, 3H) with a generated dust amount of 86 (whole particles) CPM, an average particle diameter of 1176 μm, a bulk density of 719 kg/m$^3$, a fluidity of 7.6 sec and a water content of 1.1% was obtained.

The resulting granular product was treated for 15 minutes under the following conditions: the number of revolutions of a stirring blade, 1.5 m/s (stirring Froude number, 0.5); chopper rotation, 0 r/min. (crushing Froude number, 0); jacket temperature, 85° C.; pressure, 101.3 kPa; and particle temperature, 69.8 to 72.7° C. The resulting granular anionic surfactant indicated a generated dust amount of 42 (whole particles) CPM, the surface roughness (Ra) of 0.77 μm, an average particle diameter of 1568 μm, a bulk density of 728 kg/m$^3$, a fluidity of 7.5 sec and a water content of 1.1%.

Example 4

130 kg sodium alkyl sulfate powder (EMAL 10P HD of Kao Corporation), average particle diameter 120 μm) was introduced into a vacuum drying machine with a volume of 2500 L (FDM-1200JE model manufactured by Fukae-Powtec Co., Ltd.), and while the drying conditions were regulated such that the jacket temperature was 65° C., the pressure was 5.3 kPa, and the product temperature was 46±3° C., paste 1 was dropped into the drying machine, and dried and simultaneously granulated under the granulation conditions where the stirring Froude number was 2.3 and the crushing Froude number was 25.9, whereby 538 kg granular product with a generated dust amount of 700 CPM, an average particle diameter of 1580 μm, a bulk density of 741 kg/m$^3$, a fluidity of 6.7 sec and a water content of 1.8% was obtained.

The resulting granular product was treated for 15 minutes under the following conditions: the number of revolutions of a stirring blade, 1.5 m/s (stirring Froude number, 0.5); chopper rotation, 0 r/min. (crushing Froude number, 0); jacket temperature, 65° C.; pressure, 5.3 kPa; and particle temperature, 46.1 to 49.5° C. The resulting granular anionic surfactant indicated a generated dust amount of 156 CPM, the surface roughness (Ra) of 0.63 μm, an average particle diameter of 1582 μm, a bulk density of 770 kg/m$^3$, a fluidity of 6.6 sec and a water content of 1.8%.

Example 5

900 g of a granular product of sodium alkyl sulfate (Texapon 12G manufactured by Cognis) having the following physical properties: surface roughness of 1.28 μm; amount of dust generated of 242 CPM; average particle diameter of 947 μm; bulk density of 671 kg/m$^3$; fluidity of 5.4 sec; caking property of 51%; water content of 1.7%; and effective components of 93.9%, was fed to a stirring rolling granulator (LFS-GS-2J model manufactured by Fukae-Powtec Co., Ltd.).

The granular product was treated for 30 minutes under the following conditions: the number of revolutions of a stirring blade: 0.66 m/s (stirring Froude number, 0.7 [–]); chopper rotation of 0 r/min; jacket temperature of 85° C.; and pressure of 101.3 kPa. In the step, the temperature of the powder increased from 36.8° C. to 80.9° C.

The resulting granular anionic surfactant was found to have a surface roughness of 0.49 μm, a generated dust amount of 38 CPM, an average particle diameter of 972 μm, a bulk density of 696 kg/m$^3$, a fluidity of 5.1 sec, caking property of 100%, a water content of 1.5% and effective components of 93.5%.

Example 6

130 kg of sodium alkyl sulfate powder, EMAL 10P-HD of Kao Corporation, was introduced into a vacuum drying machine (FDM-1200JE model manufactured by Fukae-Powtec Co., Ltd.). It was dried at the jacket temperature of 65° C., at the pressure of 5.3 kPa with the stirring blade at peripheral speed of 7.0 m/s (stirring Froude number, 2.3) with the crushing blade at peripheral speed of 34.9 m/s (crushing Froude number, 25.9), while paste 1 was added dropwise under controlling into the drying machine, to maintain the product temperature at 55±3° C. 631 kg of granular product of sodium alkyl sulfate having a surface roughness of 1.56 μm, a generated dust amount of 564 CPM, an average particle diameter of 1203 μm, a bulk density of 698 kg/m$^3$, a fluidity of 6.2 sec, caking property of 99%, a water content of 1.5%, effective components of 97.2% and the phase change temperature of 36° C. was obtained.

Then, 900 g of the above granular product was fed to a stirring rolling granulator (LFS-GS-2J model manufactured by Fukae-Powtec Co., Ltd.). The granular product was stirred under the same conditions as in Example 5. In the step, the temperature of the powder increased from 36.4° C. to 80.3° C.

The resulting granular anionic surfactant was found to have a surface roughness of 0.74 μm, a generated dust amount of 24 CPM, an average particle diameter of 1155 μm, a bulk density of 705 kg/m$^3$, a fluidity of 6.1 sec, caking property of 100%, a water content of 1.1% and effective components of 95.9%.

Example 7

130 kg of sodium alkyl sulfate powder (EMAL 10P HD of Kao Corporation) was introduced into a vacuum drying machine (FDM-1200JE model manufactured by Fukae-Powtec Co., Ltd.) and dried at the jacket temperature of 65° C. at the pressure of 5.3 kPa with the stirring blade at the peripheral speed of 7.0 m/s (stirring Froude number was 2.3) with the crushing blade at the peripheral speed of 34.9 m/s (the crushing Froude number was 25.9) to maintain the product temperature at 55±3° C., while paste 1 was added dropwise under controlling into the drying machine. 631 kg of a granular product of sodium alkyl sulfate having a surface roughness of 1.56 μm, a generated dust amount of 564 CPM, an average particle diameter of 1203 μm, a bulk density of 698 kg/m$^3$, a fluidity of 6.2 sec, caking property of 99%, a water content of 1.5%, effective component content of 97.2% and the phase change temperature of 36° C. or higher was obtained.

Then, 900 g of the above granular product was fed to a stirring rolling granulator (LFS-GS-2J model manufactured by Fukae-Powtec Co., Ltd.). The granular product was stirred under the same conditions as in Example 5 except that the stirring Froude number was changed from 0.7 to 1.5. In the step, the temperature of the powder increased from 30.9° C. to 85.5° C.

The resulting granular anionic surfactant was found to have a surface roughness (Ra) of 0.71 μm, a generated dust amount of 88 CPM, an average particle diameter of 1169 μm, a bulk density of 700 kg/m$^3$, a fluidity of 6.5 sec, caking property of 99.9%, a water content of 1.1% and an effective component content of 96.8%.

Comparative Example 1

130 kg sodium alkyl sulfate powder (EMAL 10P HD of Kao Corporation), average particle diameter 100 μm) was introduced into a vacuum drying machine with a volume of 2500 L (FDM-1200JE model manufactured by Fukae-Powtec Co., Ltd.), and while the drying conditions were regulated such that the jacket temperature was 85° C., the pressure was 5.3 kPa, and the product temperature was 55±3° C., paste 1 was dropped into the drying machine, and dried and simultaneously granulated under the granulation conditions where the stirring Froude number was 2.3 and the crushing Froude number was 25.9, whereby 649 kg granular product with an average particle diameter of 1164 μm, a bulk density of 709 kg/m$^3$, a fluidity of 7.4 sec, a water content of 1.1% and the phase change temperature of 40° C. was obtained.

The resulting granular product was treated for 30 minutes under the following conditions: the number of revolutions of a stirring blade, 7.0 m/s (stirring Froude number, 2.3); chopper rotation, 0 r/min. (crushing Froude number, 0); jacket temperature, 85° C.; pressure, 5.3 kPa; and particle temperature, 60.3 to 68.0° C. The resulting granular anionic surfactant was powder having an average particle diameter of 142 μm, and the amount of dust generated could not be measured.

Comparative Example 2

26 kg granular product of sodium alkyl sulfate (average molecular weight, 301) having the following physical properties: average particle diameter, 1203 μm; bulk density, 698 kg/m$^3$; fluidity, 6.2 sec.; water content, 1.5%; the ratio of particles having an average particle diameter of 500 μm or less, 0.4%; the phase change temperature of 36° C., was fed to an agitation and tambling granulator having a volume of 100 L (FS. GS. 50J model manufactured by Fukae-Powtec Co., Ltd.) The granular product was treated for 60 minutes under the following conditions: the number of revolutions of a stirring blade, 5.0 m/s (stirring Froude number, 2.9); chopper rotation, 0 r/min. (crushing Froude number, 0); jacket temperature, 30° C.; and pressure, 101.3 kPa. The particle temperature was from 60.0° C. to finally 36.4° C., and the ratio of the particles having an average particle diameter of 500 μm or less was 5.0%, and the fluidity was 7.2 sec, and the physical properties of the powder were lowered, and simultaneously a large amount of fine powder was generated, and thus the amount of dust generated could not be measured.

Formulation Examples 1 to 7

The granular anionic surfactants obtained in Examples 1 to 7 were used to prepare detergent compositions having the following composition. The resulting detergent compositions showed low dust generation and could be used as detergents.

| <Composition of the detergent compositions> | |
|---|---|
| Granular anionic surfactant (Examples 1 to 7) | 10% |
| Nonionic surfactant (Emalgen 120, Kao Corporation) | 5% |
| Soap (sodium salt of Lunac D-95 (Kao Corporation) | 2% |
| 4A-type zeolite | 30% |
| Soda ash | 15% |
| water-glass No. 1 | 5% |

-continued

| <Composition of the detergent compositions> | |
|---|---|
| Glauber's salt | 16% |
| Acrylic acid/maleic acid copolymer (Sokalan CP-5, BASF) | 3% |
| Sodium percarbonate | 10% |
| TAED | 4% |

The invention claimed is:

1. A process for producing granular anionic surfactant particles, which comprises:

a step of stirring particles in a granulator, said particles comprising 90 to 100 wt % of an anionic surfactant at a temperature of 35 to 85° C. at a stirring Froude number as defined below by equation (i) being 0.1 to less than 2.0:

$$Fr=V/[(R\times g)^{0.5}] \quad \text{(i)}$$

wherein Fr is Froude number, V is a peripheral speed at the top of a stirring blade [m/s], R is the radius of gyration of a stirring blade [m] and g is the acceleration of gravity [$m/s^2$], wherein the granulator has a clearance of from 1 to 50 mm between the stirring blade and the wall surface of the granulator, and wherein said anionic surfactant is selected from the group consisting of an alkyl sulfate, alkenyl sulfate, alkyl ether sulfate and alkenyl ether sulfate; and a step of producing said granular particles having 90 to 100% anionic surfactant content.

2. The process according to claim 1, wherein the anionic surfactant-comprising particles are obtained by drying and simultaneously granulating a powdery material, while adding an anionic surfactant paste to the powdery material at a reduced pressure in a granulator having a stirring blade and a crushing blade, and wherein said particles are stirred at a crushing Froude number of from 5 to 40 as determined by formula (I).

3. The process according to claim 2, wherein the temperature in the granulator is substantially constant.

4. The process according to claim 1, which further comprises the step of removing fine particles by a vibrating classification screen and/or an air classifier after the stirring step.

5. A granular anionic surfactant particle obtained by the process according to claim 4.

6. The process according to claim 1, wherein said stirring Froude number ranges from 0.1 to 0.7.

* * * * *